United States Patent [19]

Antone

[11] 4,406,182

[45] Sep. 27, 1983

[54] CHAMPAGNE CORK REMOVER

[76] Inventor: Howard J. Antone, 12284 Adine Ct., Glen Ellen, Calif. 954422

[21] Appl. No.: 469,413

[22] Filed: Feb. 24, 1983

Related U.S. Application Data

[63] Continuation of Ser. No. 291,382, Aug. 10, 1981, abandoned.

[51] Int. Cl.[3] ..... B67B 7/06

[52] U.S. Cl. ..... 81/3.38 R; 29/266

[58] Field of Search ..... 81/3.34, 3.36, 3.37, 81/3.38 R, 3.46 A, 3.38 A, 3.42; 29/266

[56] References Cited

U.S. PATENT DOCUMENTS 664,565 12/1900 Livingood ..... 29/213

1,866,125 7/1932 Patterson ..... 81/338 R 2,761,338 9/1956 Hardy ..... 81/3.42

FOREIGN PATENT DOCUMENTS 368138 3/1932 United Kingdom ..... 81/3.37

*Primary Examiner*—Roscoe V. Parker

*Attorney, Agent, or Firm*—Naylor, Neal & Uilkema

[57] ABSTRACT

A champagne cork remover device is provided with a plurality of relatively movable frame members, the lowermost one being shaped to lock onto the neck of a champagne bottle, the intermediate one being adapted to be engaged beneath the cork and lift it free, and the uppermost one being adapted to serve as the carrier for a screw shaft actuator.

2 Claims, 5 Drawing Figures

CHAMPAGNE CORK REMOVER

This application is a continuation of application Ser. No. 291,382, filed Aug. 10, 1981 and now abandoned.

BACKGROUND OF THE INVENTION

The field of the invention is stopper removers for bottles and the like. The invention relates more particularly to the removal of corks from champagne bottles. Such corks are typically made of plastic and have a stem portion which serves to stopper the bottle and an enlarged head portion which overlies the pouring lip of the bottle.

I am unaware of any cork remover devices for such champagne bottles. To my knowledge champagne corks of the described type have only been removed by hand after tedious manipulation which culminates in an explosive disconnection of the cork from the bottle accompanied by a discharge of champagne as the pressurizing medium is released.

SUMMARY OF THE INVENTION

An object of the invention is to provide a champagne cork remover device which remains interconnected to the bottle and to the cork as the latter is moved to a position of release, thereby maintaining the cork in captured relation even though it is released from the bottle and enabling a controlled release of the cork and a consequent controlled release of the pressure medium whereby there is no loss of contents by discharge.

A further object of the invention is to provide a champagne cork remover device with bottle anchoring means adapted to have a two-way connection with the bottle neck.

Other objects and advantages of the invention will be apparent from the drawing and the following description.

DESCRIPTION OF THE PREFERRED EMBODIMENT

Figure 1:
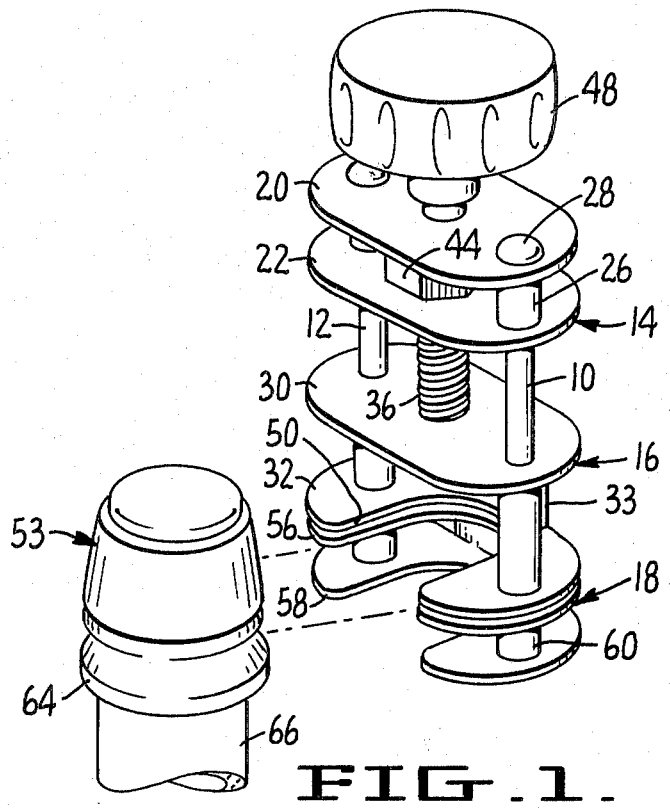
FIG. 1 is a view in perspective of the cork remover of the invention and the end of an unopened champagne bottle.
Figure 5:
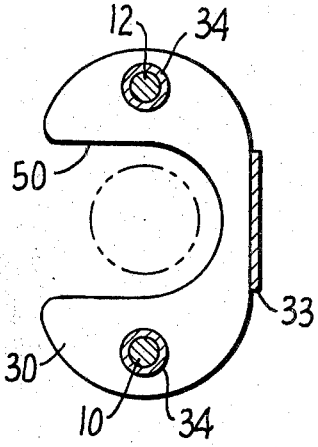
FIG. 5 is a view in detail taken along lines 5—5 of FIG. 4.

The device comprises a pair of spaced, parallel shafts 10 and 12 and first, second and third frames 14, 16 and 18, respectively, mounted thereon.

The first frame 14 comprises plate elements 20 and 22 interconnected by web 24, spacer sleeves 26 having flanges at their upper ends in overlying relation to the ends of the shafts 10 and 12, and drive screws 28. The first frame 14 is thereby fixed to the upper ends of shafts 10 and 12 against movement relative thereto.

The second frame 16 comprises plate elements 30 and 32, interconnecting web 33, and spacer sleeves 34 slidably disposed on shafts 10 and 12.

The second frame 16 is provided with drive means comprising screw shaft 36 which is rotatable in the upper plate element 30 of the second frame 16 but has a two-way axial connection therewith comprising shoulder 38 formed on the screw shaft, groove 40 formed in shaft 36 and lock ring 42. The screw shaft 36 is threadably connected with nut 44 which is carried between plate elements 20 and 22 of the first frame 14 and is anchored against rotation, as by pin 46. The upper end of the screw shaft has fixedly secured thereto a knob-like handle 48.

The plate element 32 of frame 16 is provided with a recessed edge 50 which is adapted to be engaged beneath the enlarged head portion 52 of a champagne cork 53 which is further comprised of stem 54.

The third frame 18 comprises plate elements 56 and 58, interconnecting web 59, spacer sleeves 60 having inturned lower end flanges which overlie the ends of shafts 10 and 12, and drive screws 62. The plate elements 56 and 58 are recessed so that they may be fitted over and under, respectively, the shoulder 64 formed on the bottle neck 66. The third frame 18 therefore constitutes a means for preventing any substantial degree of axial movement between the device and the bottle neck during use of the device.

Figure 2:
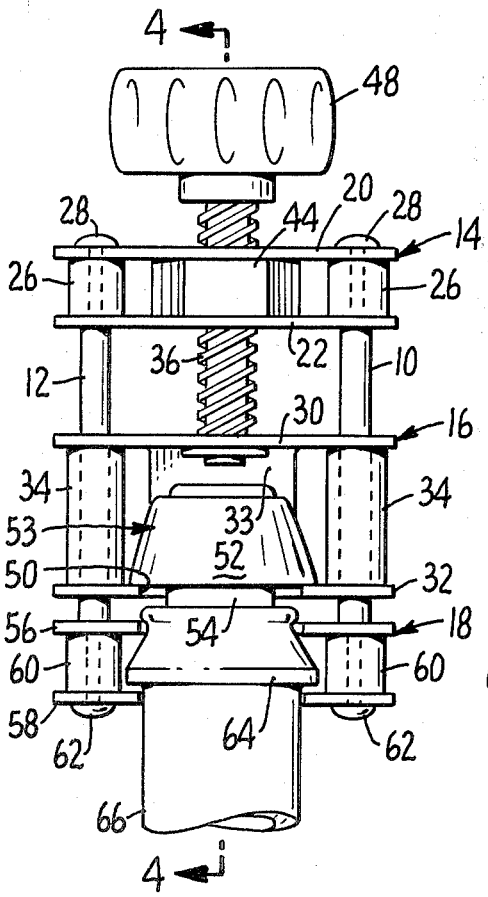
FIG. 2 is a view in front elevation of the remover in applied relation to the bottle preliminary to the cork removal operation.
Figure 3:
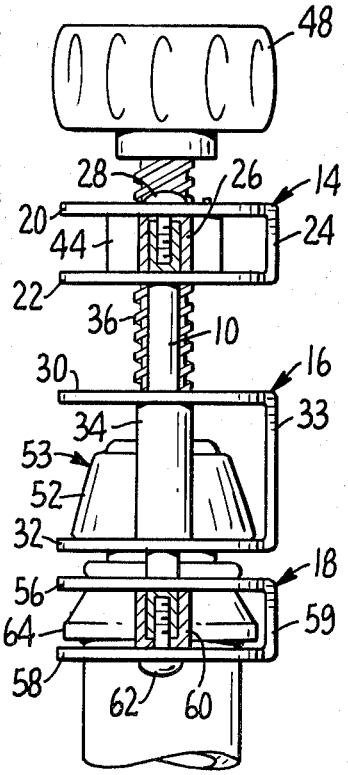
FIG. 3 is a view in right side elevation of the device as shown in FIG. 2.
Figure 4:
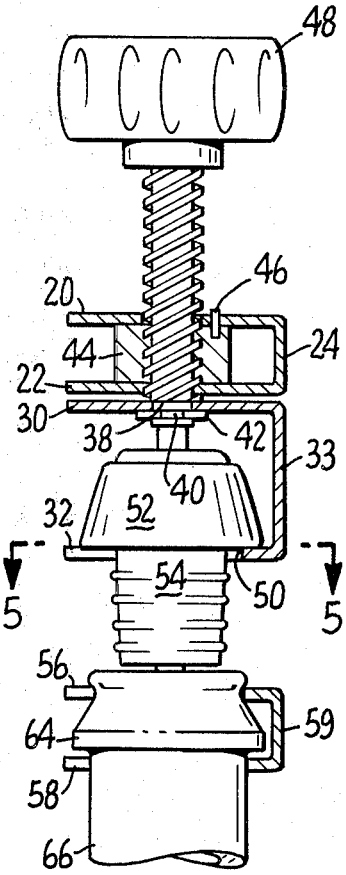
FIG. 4 is a view taken along lines 4—4 of FIG. 2 but showing the device at the end of the cork removal operation.

The device is used as follows. It is placed on the bottle in the FIG. 2 position, the plate elements of frame 18 being disposed in capturing relation to the bottle neck flange or shoulder 64 and the recessed edge 50 of frame 16 being positioned in underlying relation to the enlarged head or crown 52 or cork 53. The knob 48 is then rotated to move the screw shaft 36 upwardly to the FIG. 4 position, thereby causing the plate element 32 of frame 16 to pull the cork 53 out of the bottle as the plate element 56 of frame 18 presses down on the sloping upper side of bottle neck shoulder 64.

The movement of the cork in the removal process is relatively slow and controlled. This makes for a non-explosive opening of the bottle and a consequent absence of the discharge of contents as the cork is removed. It will also be noted that the head or crown of the cork remains in captured relation within frame 16 as cork removal occurs and that the frame 18 remains in captured relation to the bottle shoulder 64 as cork removal occurs.

What is claimed is:

1. A champagne cork remover comprising a pair of spaced, parallel shafts having upper and lower ends, first, second and third frames positioned on the shafts, the first frame being fixedly secured to the shafts adjacent the upper ends thereof, the second frame being movably mounted on the shafts, the third frame being fixedly secured to the shafts adjacent the lower ends thereof, actuating means for moving the second frame comprising a screw shaft having a threaded connection with the first frame and a two-way follower connection with the second frame and a handle secured to said screw shaft, said second frame comprising a generally planar plate recessed to receive the stem of a champagne cork and adapted to engage the underside of the head of the cork and remove the cork upon upward movement of said second frame relative to said third frame, said third frame comprising a plate recessed to receive the neck of a champagne bottle and adapted to engage the bottle above a laterally enlarged portion of said neck.

2. The champagne cork remover of claim 1, said second frame further comprising a second plate disposed above the recessed plate a distance slightly greater than the height of the head of the cork so as to loosely capture therebetween the head of the cork upon the release of the cork from the bottle, said screw shaft being connected to said second plate, said third frame comprising a second recessed plate adapted to engage the bottle below the laterally enlarged portion of said neck and thereby secure the third frame to the bottle against substantial vertical movement.

* * * * *